US007919433B2

(12) United States Patent
Cullen et al.

(10) Patent No.: US 7,919,433 B2
(45) Date of Patent: Apr. 5, 2011

(54) CHROMOGENIC MEDIA RESPONSIVE TO ENVIRONMENTAL CONDITIONS

(75) Inventors: Philip Michael Cullen, Lexington, KY (US); Dell T. Rosa, Winchester, KY (US); Louann Behymer Samuels, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 1033 days.

(21) Appl. No.: 11/427,348

(22) Filed: Jun. 29, 2006

(65) Prior Publication Data

US 2008/0004176 A1 Jan. 3, 2008

(51) Int. Cl.
*B41M 5/34* (2006.01)

(52) U.S. Cl. ..... 503/204; 503/201

(58) Field of Classification Search ..... None
See application file for complete search history.

(56) References Cited

U.S. PATENT DOCUMENTS

| | | | | |
|---|---|---|---|---|
| 5,595,955 | A | 1/1997 | Chang et al. | |
| 5,826,915 | A | 10/1998 | Gregory, Jr. | |
| 5,883,043 | A | 3/1999 | Halbrook, Jr. et al. | |
| 6,022,648 | A * | 2/2000 | Jacobson et al. | 430/19 |
| 6,060,428 | A | 5/2000 | Chang et al. | |
| 6,613,715 | B2 * | 9/2003 | Kutami et al. | 503/201 |
| 6,694,912 | B2 | 2/2004 | Wesley | |
| 6,713,430 | B2 * | 3/2004 | Tominaga et al. | 503/201 |

* cited by examiner

*Primary Examiner* — Bruce H Hess

(57) ABSTRACT

The present invention relates to chromogenic material that may respond and shift in color due to environmental conditions such as heat, light or humidity. The light may include both visible and non-visible light, such as ultraviolet light. The chromogenic material may therefore provide a method to independently develop a latent image on a given substrate, and in particular, to a substrate that includes conventional thermosensitive image forming media.

24 Claims, 5 Drawing Sheets

CHROMOGENIC MEDIA RESPONSIVE TO ENVIRONMENTAL CONDITIONS

FIELD OF THE INVENTION

The present invention relates to chromogenic media that may respond to environmental conditions such as heat, light and/or humidity to provide a developed latent image on a given substrate. The substrate may include thermosensitive recording material and the chromogenic media may provide information to a consumer, particularly in the event the thermosensitive recording is non-permanent or no longer legible.

BACKGROUND OF THE INVENTION

Thermosensitive recording material may be coated or impregnated with a thermochromic compound capable of developing color upon exposure to heat. The thermosensitive material may be fed through a thermal printer to selectively heat the thermochromic compound, which may change color in the heated locations to produce a visible image. Such images may be produced in one or two colors, where development of a second color may occur by subjecting one thermochromic compound to two levels of heat. Low heat may develop a first color and high heat may bleach the first color and develop a second color.

Such thermosensitive recording materials may have the drawback of being relatively non-permanent and sensitive to environmental conditions such as heat, light and/or moisture. Overexposure to those and other conditions may lead to a fading or darkening of the visible image and/or paper background, thereby reducing the legibility of the visible image. This may present relatively serious problems, as in the case of a pharmaceutical label, where important prescription information may be compromised. Furthermore, overexposure to degrading influences may directly jeopardize the safety and/or efficacy of the products (e.g. pharmaceuticals) which thermosensitive labels typically serve to identify.

SUMMARY OF THE INVENTION

In a first exemplary embodiment, the present invention relates to a medium capable or developing a latent image. The medium includes a substrate having a surface wherein the surface includes a first chromogenic material providing a first image. A second chromogenic material may then be applied to the substrate that is capable of providing a secondary image wherein the secondary image is capable of developing upon exposure to an environmental condition. The secondary image, prior to exposure to the environmental condition, may be transparent relative to the first image, and the environmental condition may render the first image as illegible.

In a second exemplary embodiment, the present invention relates to a medium capable of developing a latent image. The medium may again include a substrate having a surface, wherein the surface includes a first chromogenic material providing a first image. A second non-chromogenic material may then be applied to the surface that is capable of providing a secondary image on the substrate when the first chromogenic material is exposed to an environmental condition. The non-chromogenic material may be transparent relative to the first image.

In yet another exemplary embodiment, the present invention relates to a method of developing a latent image on a substrate upon exposure to an environmental condition. The method includes providing a substrate having a surface, wherein the surface contains a first chromogenic material that is capable of forming a first image from the first chromogenic material. A second chromogenic material may be applied to the substrate wherein the second chromogenic material is capable of forming a second image upon exposure to an environmental condition, wherein the environmental condition is capable of rendering the first image as illegible.

DETAILED DESCRIPTION

The present invention relates to chromogenic material that may respond and shift in color due to environmental conditions such as heat, light or humidity. The light may include both visible and non-visible light, such as ultraviolet light. The chromogenic material may therefore provide a method to independently develop a latent image on a given substrate, and in particular, to a substrate that includes conventional thermosensitive image forming media. The chromogenic material may therefore be applied to a substrate which may initially contain image forming media that may respond adversely to a given environment and otherwise become illegible. The chromogenic material herein may therefore separately provide the ability to communicate useful information on products such as pharmaceutical labels, retail pricing labels, shelf marking labels, food industry labels, luggage ticketing, manufacturing distribution media, packing and shipping labels, etc. Such information may include historical environmental exposure information and/or other labeling indications that may be appropriate for a given product.

Figure 1:
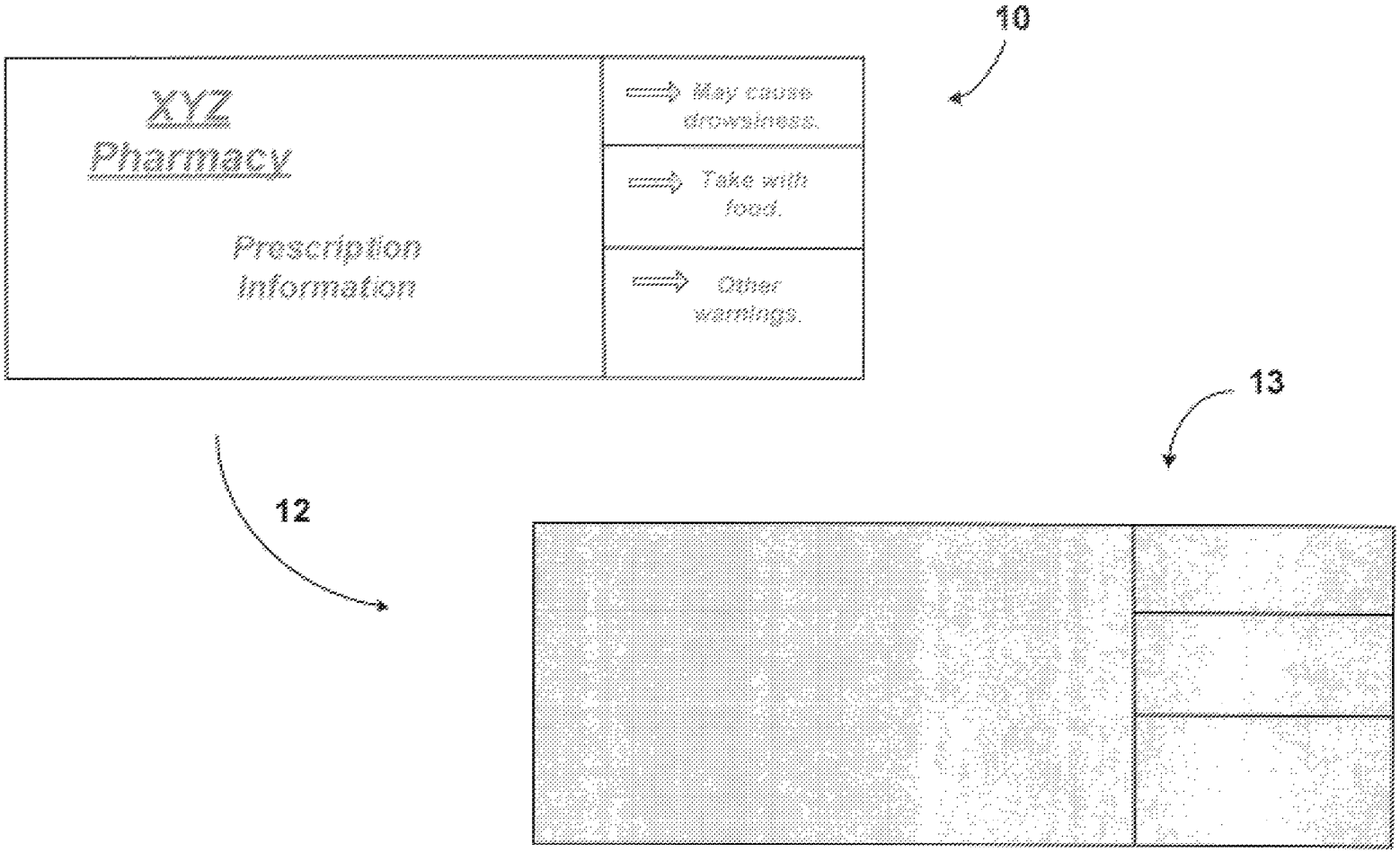
FIG. 1 illustrates loss in contrast of a first visible image on an exemplary substrate.

FIG. 1 illustrates the application of the present invention to a substrate 10 that may include a pharmaceutical type prescription label that may be formed from thermal media. While the present invention is therefore illustrated in connection with such label product, it may be appreciated, as alluded to above, that the chromogenic material herein may be applied to any number of a variety of substrates. A pharmaceutical label may be understood herein as a label that is typically affixed to a container containing a pharmaceutical product (prescription or non-prescription) for use by the consumer. Accordingly, such would apply to medicines taken or used by consumers, as well as over-the-counter type products. It may also contemplate a number of other related products where shelf-life may be of importance.

As shown therefore in FIG. 1, substrate 10 may typically include a visible first or primary image or indicia common to a pharmaceutical label which may include appropriate warning information. Such image and/or indicia may be sourced from a first chromogenic material. However, upon exposure to environmental conditions, it may be appreciated that heat, sunlight (UV), humidity, etc. may alter the label color and obscure the printing. This may be particularly the case with labels that rely upon conventional thermal printing which includes a base sheet, a base coating and a thermosensitive coating. Thermosensitive coatings may be understood to include various color forming chemicals and additives such that when heat is applied by a thermal head, the color forming chemicals may react to develop a desired print image.

As illustrated in FIG. 1, in the event that label was again heated at 12, it is possible that the entire label, containing e.g., a thermosensitive coating, may darken and lead to a partial or total loss in contrast. Important information may therefore no longer be available for viewing as shown generally at 13. It is also worth noting that environmental exposure may adversely influence the contents associated with the label. For example, in the case of a particular pharmaceutical associated with a given pharmaceutical label, one might anticipate that exposure to heat may lead to reduced pharmacological effectiveness and/or even the development of some toxic by-products.

Figure 2:
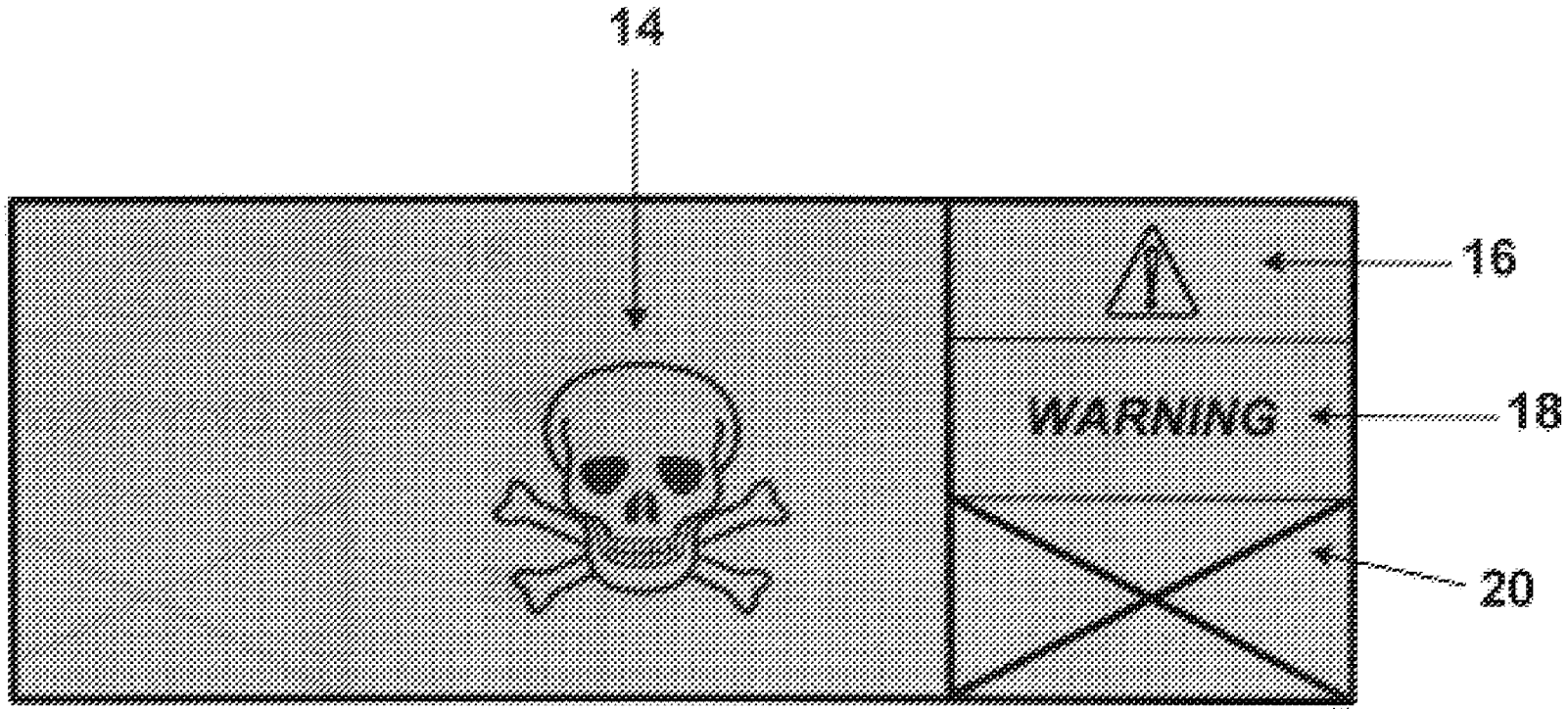
FIG. 2 illustrates development of a latent image from chromogenic media applied to the substrate of FIG. 1, wherein the background has darkened.

With attention directed to FIG. 2, it may be appreciated that by separately providing to the substrate 10 (see FIG. 1) chromogenic material that is responsive to one or more environmental conditions (heat, light, and/or humidity), the chromogenic material may be applied with any one of a variety of latent images, illustrated in developed form generally at 14, 16, 18 and 20. Accordingly, such chromogenic material may be applied such that as illustrated in FIG. 1, the latent image remains relatively transparent to the user until a targeted environmental condition may be experienced. Reference to transparent may be understood to include a latent image that may be, while partially detectable, relatively transparent to the unaided human eye when viewed in visible light and may therefore be one that does not interfere with the information provided by the visible primary image. In addition, as illustrated, the separately provided chromogenic material is applied to the same surface that contains the thermosensitive coating.

When an particular environmental condition is therefore experienced, a latent image develops as shown in FIG. 2, and in particular, such latent image may develop under those circumstances where the original information from the visible primary image (see again FIG. 1) is no longer visible. It should also be appreciated that the chromogenic material and latent image associated therewith may be placed at any desired portion on the substrate 10. For example, it may be placed in the same area that the primary visible image appears, which is shown by latent image 14. In addition, the latent image may be applied to its own dedicated area of the substrate, as shown by items 16, 18 and 20. The latent image may therefore cover all, none or a portion of the primary visible image. Furthermore, the chromogenic material may develop the latent image into any desired color, although black is utilized in FIG. 2 for exemplary purposes.

Figure 3:
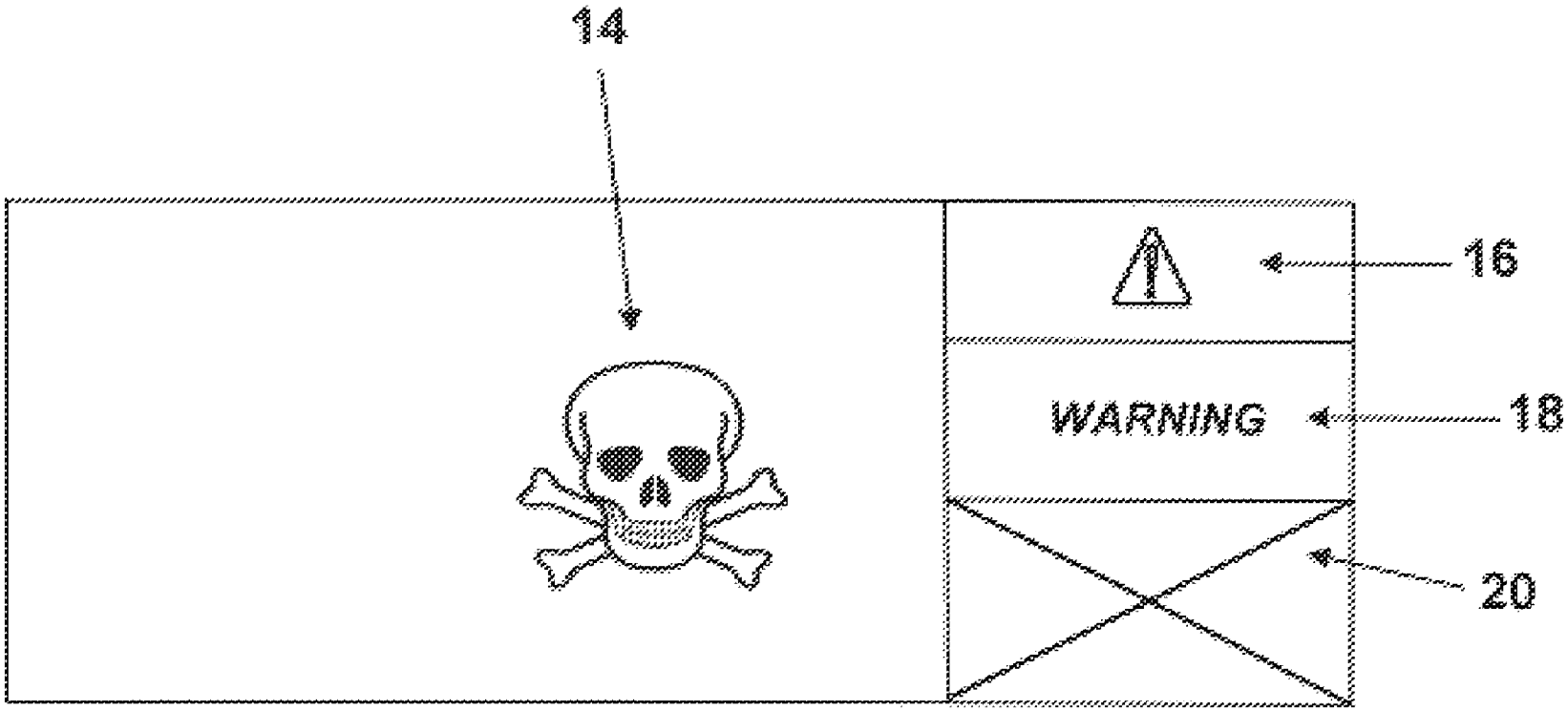
FIG. 3 illustrates the development of a latent image from chromogenic media applied to the substrate of FIG. 1, wherein the background has lightened.

With respect to the latent images 14, 16, 18, 20, it should be noted that such images may be designed such that as developed, they assume a color that may be legible and contrast with any colored background, e.g. from a white, gray or even a black background. For example, as shown in FIG. 3, in the event that the background that is lightened due to environmental exposure, wherein the original text fades or is obscured, the latent warnings may be of a color such as red, orange green or blue which may contrast will against white, gray or even black backgrounds. In additions, the latent warnings may be formed from shaded lettering such that upon development, the shaded lettering is visible to those individuals who may otherwise suffer from some form of color blindness.

It may therefore be appreciated that the present invention may also utilize a chromogenic material and/or a non-chromogenic material. Accordingly, the latent image, as noted above, may develop into a pattern which contrasts against backgrounds of varying darkness. However, the latent image now may be applied to the substrate as separate side-by-side layers. For example, one layer may be a chromogenic material and one layer may be a non-chromogenic material. In addition, one may include layers that may include mixtures of a chromogenic material with a non-chromogenic material. The non-chromogenic material may be in the form of an ink, dye, paint, and/or pigment. The layers may be applied alongside one another either in abutting relationship or even with some degree of overlap. For example, the side-by-side layers may overlap between 1-99%, including all values and increments therein. It may also be appreciated that the combination of a non-chromogenic material (e.g. white in color) with a chromogenic material (which develops white to black) may then provide a gray scale upon development. However, black, red, or any other color may be used to form a gray scale pattern.

Figure 4B:
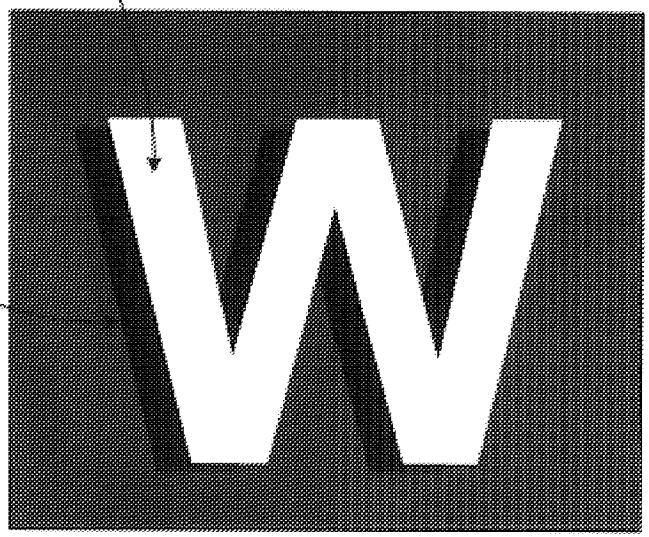
FIG. 4B illustrates the effect of background darkening to the media of FIG. 4A.
Figure 4A:
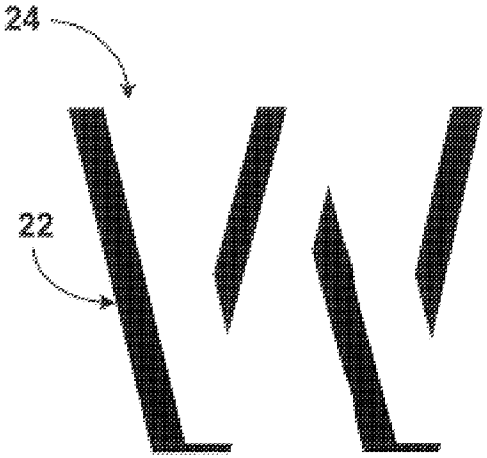
FIG. 4A illustrates a developed latent image based upon chromogenic media in combination with non-chromogenic media.
Figure 5:
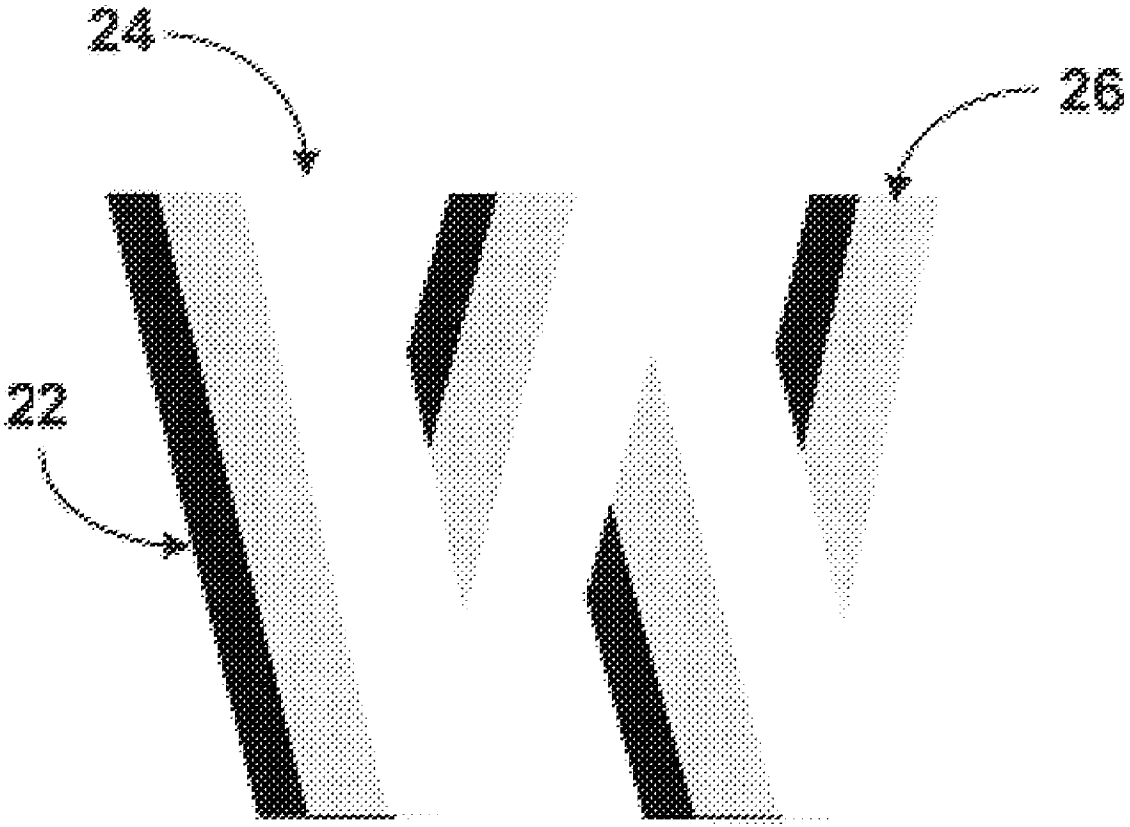
FIG. 5 illustrates the use of a mixture of chromogenic and non-chromogenic material to provide a gray-scale image.

FIG. 4A illustrates a developed latent image "W" which may be associated with the complete term "WARNING." It may therefore be appreciated that one may employ a chromogenic material that develops into a black color as shown generally at 22. In addition, as shown generally at 24, one may employ a non-chromogenic material that initially matches the color of the underlying substrate, and therefore would remain initially transparent relative to a first image produced by chromogenic material. For example, the non-chromogenic material may be white and as illustrate, 22 and 24 may be positioned in overlapping relationship. As the background darkens as shown in FIG. 4B, it can be observed that the non-chromogenic material 24 becomes relatively more visible and legible to the consumer. As noted above, one may also provide a mixture of chromogenic and non-chromogenic material, in which case one may develop a gray-scale type image, as shown generally as item 26 in FIG. 5. It should also be appreciated that one may utilize chromogenic material that shifts from the color white to any other color that may be desired. Further, the simultaneous use of chromogenic material and non-chromogenic material may allow the latent image to ultimately be legible against both faded and darkened backgrounds.

It should now be appreciated that reference to a chromogenic material herein contemplates any image forming material capable of developing a color upon exposure to one or more environmental conditions. The environmental conditions, as alluded to above, include but are not limited to light (photochromism), heat (thermochromism), electrical current (electrochromisn), solvent polarity (solvatochromism), ions (ionochromism), pH (halochromism), mechanical friction (tribochromism), mechanical pressure (piezochromism), or a combination thereof. Thus, the chromogenic material may herein be additionally characterized as photochromic, thermochromic, etc. Further, a chromogenic material herein may change color reversibly or irreversibly.

Expanding upon the above, the second chromogenic material may be tailored to appear when an environmental condition occurs which is adverse to either the chromogenic media responsible for the primary image, and/or the particular product identified by the primary image. For example, in the case of a pharmacy prescription label, the temperature at which the second chromographic material changes color may be selected at a typical threshold for a given medication. This may be the case as various medications typically require specific storage requirements or even refrigeration to remain generally effective. Accordingly, the second chromogenic material may be selected so that it develops in the event that it is exposed to temperatures of greater than about 50° C. (122° F.). In addition, the second chromogenic material may be selected so that it develops in the event that it is exposed to a given temperature for a given length of time. For example, 38° C. (100° F.) for a period of 72 hours.

As noted above, the second chromogenic material may be applied in the form of a localized coating on one or more surfaces of the substrate, including the same surface or surfaces in which the first chromogenic material is located. The localized coating may be applied by a variety of printing methods, including but not limited to flexographic, gravure, or screen printing methods. The localized coating may further be applied in the form of words, pictures, or symbols, including but not limited to warnings, instructions, prices, expiration dates, barcodes, or shipping locations.

It may further be appreciated herein that reference to a medium that may be capable of developing a latent image includes any substrate which is coated, impregnated, or otherwise contains a chromogenic material. The substrate may be paper or a polymeric material and may have one or more surfaces. One surface may be also coated with an adhesive such that the substrate may be used as a label. The substrate may be coated, impregnated, or otherwise contain a first chromogenic material for printing a visible primary image on the substrate. Where the substrate contains a thermochromic material, it may be fed into a thermal printer. The thermal printer may selectively heat the substrate, develop the thermochromic material, and form a visible primary image. It is this substrate and this primary visible image which may fade or darken beyond a legible state when exposed to one or more degrading influences.

The invention may be further illustrated by the following examples. It should be understood that it is not intended to limit the scope of this invention.

EXAMPLE 1

Labels were produced by hand painting warning indicators on white undeveloped thermal paper stock. The ink used was a thermochromic white to black ink with a change temperature of about 90° C. available from TMC under the name Kromagen Flexo Ink. In order to achieve a measure of gray scale in the warning indicators, the Kromagen ink was blended with Titanium White Liquitex, a non-chromogenic white acrylic paint available for Liquitex, Piscataway, N.J. Three layers were used: a pure non-chromogenic white acrylic paint; a gray blend of the non-chromogenic white acrylic paint and the thermochromic white to black ink; and a pure thermochromic white to black ink. The word "WARNING" was hand painted on the labels such that each letter of text was painted with each of the three layers. On the white undeveloped thermal paper, prior to exposure to any degrading influence, the latent "WARNING" image was not generally visible.

EXAMPLE 2

The white undeveloped thermal paper with latent "WARNING" images of Example 1 was exposed to 50° C. for a period of one hour, after which the pure Kromagen ink showed indications of darkening. Upon exposure to 60° C. for a period of one hour, the pure Kromagen ink showed further indications of darkening and the gray blend began developing. The black and gray scale portions of the "WARNING" image were legible against the relatively light background. Upon exposure to 95° C. for a period of 15 minutes, the Kromagen ink fully developed, and the background of the label turned a dark gray color. Against this relatively dark background, the white and gray scale portions of the "WARNING" image were legible. Example 2 thus illustrates that thermochromic white to black ink, in conjunction with the gray scale mixture of Example 1, may enhance the legibility of a latent image when heat exposure has not yet darkened the thermal paper background. Example 2 further illustrates that non-chromogenic white paint on white thermal paper, in conjunction with the gray scale mixture of Example 1, may enhance the legibility of a latent image when heat exposure darkens the thermal paper background.

EXAMPLE 3

The white undeveloped thermal paper with latent "WARNING" images of Example 1 was moistened slightly and exposed to microwave energy for 120 seconds. The background of the label turned black, obscuring the visible image. Against this relatively dark background, the white and gray scale portions of the "WARNING" image were legible. Example 3 thus illustrates that non-chromogenic white paint on white thermal paper, in conjunction with the gray scale mixture of Example 1, may enhance the legibility of a latent image when moisture and microwave energy darken the thermal paper background.

EXAMPLE 4

The white undeveloped thermal paper with latent "WARNING" images of Example 1 was exposed to microwave energy for 120 seconds followed by exposure to 60° C. and 85% relative humidity for seven days. Such adverse environmental factors induced patchy fading of the labels, obscuring the visible image. Against this relatively light background, the black and gray scale portions of the "WARNING" image were legible. Example 4 thus illustrates that thermochromic white to black ink, in conjunction with the gray scale mixture of Example 1, may enhance the legibility of a latent image when microwave energy and high humidity fade the thermal paper background.

EXAMPLE 5

The white undeveloped thermal paper with latent "WARNING" images of Example 1 was exposed to a simulated one year of direct sunlight and a simulated 17 years of direct sunlight. Labels that had previously been darkened due to heat or microwave energy exhibited background fading in response to the simulated 17 years of direct sunlight. The "WARNING" image developed in the light chamber, possibly due to warmth from the lamps, such that the black ink contrasted prominently against the faded background. Example 5 illustrates that thermochromic white to black ink may enhance the legibility of a latent image when direct sunlight fades the thermal paper background.

The foregoing description is provided to illustrate and explain the present invention. However, the description hereinabove should not be considered to limit the scope of the invention set forth in the claims appended hereto.

What is claimed is:

1. A medium capable of developing a latent image comprising:

a substrate having a surface, wherein said surface includes a first chromogenic material providing a first image, said first image being rendered irreversibly illegible upon exposure to an environmental condition; and a second chromogenic material capable of providing a secondary image wherein said secondary image is capable of developing upon exposure to said environmental condition from which said first image is rendered irreversibly illegible.

2. The medium of claim 1 wherein said secondary image, prior to exposure to said environmental condition, is transparent relative to said first image.

3. The medium of claim 1 wherein upon exposure to said environmental condition, said first chromogenic material is capable of undergoing a color change and said secondary image is capable of undergoing a color change that contrasts with said first chromogenic material color change.

4. The medium of claim 1 wherein said environmental condition comprises exposure to heat, light, electric, solvent, ions, pH change, mechanical friction, mechanical pressure, or combinations thereof.

5. The medium of claim 1 wherein said first image is formed from a thermochromic ink, dye, paint and/or pigment.

6. The medium of claim 1 further comprising an adhesive on said substrate.

7. The medium of claim 1 wherein said second chromogenic material is a thermochromic and/or photochromic ink, dye, paint, and/or pigment.

8. The medium of claim 1 wherein said first image is thermally printed.

9. The medium of claim 1 wherein said secondary image covers all, none, or a portion of said first image.

10. The medium of claim 1 in the form of a pharmaceutical label.

11. The medium of claim 1, further comprising a third material capable of providing an image, wherein said third material, prior to exposure to said environmental condition, is substantially transparent relative to said first image.

12. The medium of claim 11, wherein the said third material comprises a non-chromogenic material.

13. The medium of claim 1, wherein said environmental condition comprises exposure to a predetermined temperature for a predetermined period of time, such that said first image is rendered irreversibly illegible only upon exposure to said predetermined temperature for said predetermined period of time.

14. The medium of claim 13, wherein said predetermined period of time is about 72 hours.

15. The medium of claim 1, wherein said second chromogenic material comprises a layer of pure non-chromogenic white acrylic paint, a layer of gray blend of non-chromogenic white acrylic paint and thermochromic white to blank ink, and a layer of pure thermochromic white to black ink.

16. The medium of claim 1, wherein the secondary image irreversibly develops upon exposure to said environmental condition.

17. A method of developing a latent image upon exposure to an environmental condition, comprising:

providing a substrate having a surface, wherein said surface contains a first chromogenic material capable of forming a first image;

applying a second chromogenic material wherein said second chromogenic material is capable of forming a secondary image upon exposure to an environmental condition, wherein said environmental condition which forms said second image renders said first image irreversibly illegible.

18. A medium capable of developing a latent image comprising:

a substrate having a surface, wherein said surface includes a first material providing a first image, said first image being rendered irreversibly illegible upon exposure to an environmental condition; and a second material capable of providing a secondary image, wherein said secondary image developing upon exposure to said environmental condition from which said first image is rendered irreversibly illegible, at least one of said first material and said second material comprising chromogenic material.

19. The medium of claim 18, wherein both said first material and said second material comprise chromogenic material.

20. The medium of claim 18 wherein said secondary image, prior to exposure to said environmental condition, is transparent relative to said first image.

21. The medium of claim 18 wherein upon exposure to said environmental condition, said first material undergoes an irreversible color change and said secondary image undergoes a color change that contrasts with said first material irreversible color change.

22. The medium of claim 18 wherein said environmental condition comprises exposure to heat, light, electric, solvent, ions, pH change, mechanical friction, mechanical pressure, or combinations thereof.

23. The medium of claim 18, wherein said environmental condition comprises exposure to a predetermined temperature for a predetermined period of time, such that said first material is rendered irreversibly illegible only upon exposure to said predetermined temperature for said predetermined period of time.

24. The medium of claim 23, wherein the secondary material irreversibly develops upon exposure to said environmental condition.

* * * * *